US007832482B2

(12) United States Patent
Cavender et al.

(10) Patent No.: US 7,832,482 B2
(45) Date of Patent: Nov. 16, 2010

(54) PRODUCING RESOURCES USING STEAM INJECTION

(75) Inventors: Travis W. Cavender, Angleton, TX (US); Jody R. McGlothen, Waxahachie, TX (US); David Steele, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 174 days.

(21) Appl. No.: 11/545,369

(22) Filed: Oct. 10, 2006

(65) Prior Publication Data

US 2008/0083536 A1 Apr. 10, 2008

(51) Int. Cl.
*E21B 43/24* (2006.01)

(52) U.S. Cl. ..... 166/302; 166/303; 166/305.1; 166/272.3; 166/272.1

(58) Field of Classification Search ..... 166/302, 166/303, 263, 305.1, 272.3, 272.1, 62, 106
See application file for complete search history.

(56) References Cited

U.S. PATENT DOCUMENTS

| | | | | |
|---|---|---|---|---|
| 1,263,618 | A | 4/1918 | Squires | |
| 1,342,741 | A | 6/1920 | Day | |
| 1,457,479 | A | 6/1923 | Wolcott | |
| 1,726,041 | A | 8/1929 | Powell | |
| 1,918,076 | A | 7/1933 | Woolson | |
| 2,173,556 | A | 9/1939 | Hixon | |
| 2,584,606 | A | 2/1952 | Merriam et al. | |
| 2,647,585 | A * | 8/1953 | Roberts | 166/61 |
| 2,670,802 | A | 3/1954 | Ackley | |
| 2,734,578 | A | 2/1956 | Walter | |
| 2,767,791 | A | 10/1956 | van Dijck | |

(Continued)

FOREIGN PATENT DOCUMENTS

| | | |
|---|---|---|
| EP | 0 069 827 | 1/1983 |

(Continued)

OTHER PUBLICATIONS

Claes Palmgren, Institut Francais du Petrole, and Neil Edmunds, "*High Temperature Naptha to Replace Steam in the SAGD Process*," SPE 30294, Society of Petroleum Engineers, copyright 1995, pp. 475-485.

(Continued)

*Primary Examiner*—William P Neuder
*Assistant Examiner*—Sean D Andrish
(74) *Attorney, Agent, or Firm*—Joshua A. Griswold

(57) ABSTRACT

A system for producing fluids from a subterranean zone comprises a tubing string disposed in a well bore, the tubing string adapted to communicate fluids from the subterranean zone to a ground surface. A downhole fluid lift system is operable to lift fluids towards the ground surface. A downhole fluid heater is disposed in the well bore and is operable to vaporize a liquid in the well bore. A seal between the downhole fluid lift system and the downhole fluid heater is operable to isolate a portion of the well bore containing the downhole fluid lift system from a portion of the well bore containing the downhole fluid heater. A method comprises: disposing a tubing string in a well bore; generating vapor in the well bore; and lifting fluids from the subterranean zone to a ground surface through the tubing string.

18 Claims, 7 Drawing Sheets

U.S. PATENT DOCUMENTS

| | | | |
|---|---|---|---|
| 2,825,408 | A | 3/1958 | Watson |
| 2,862,557 | A | 12/1958 | van Utenhove et al. |
| 2,880,802 | A | 4/1959 | Carpenter |
| 2,889,881 | A | 6/1959 | Trantham et al. |
| 2,901,043 | A | 8/1959 | Campion et al. |
| 2,914,309 | A | 11/1959 | Salomonsson |
| 3,040,809 | A | 6/1962 | Pelzer |
| 3,055,427 | A | 9/1962 | Pryor et al. |
| 3,113,619 | A | 12/1963 | Reichle |
| 3,127,935 | A | 4/1964 | Poettmann et al. |
| 3,129,757 | A | 4/1964 | Sharp |
| 3,135,326 | A | 6/1964 | Santee |
| 3,141,502 | A | 7/1964 | Dew et al. |
| 3,154,142 | A | 10/1964 | Latta |
| 3,156,299 | A | 11/1964 | Trantham |
| 3,163,215 | A | 12/1964 | Stratton |
| 3,174,544 | A | 3/1965 | Campion et al. |
| 3,182,722 | A | 5/1965 | Reed |
| 3,205,944 | A | 9/1965 | Walton |
| 3,221,809 | A | 12/1965 | Walton |
| 3,232,345 | A | 2/1966 | Trantham et al. |
| 3,237,689 | A | 3/1966 | Justheim |
| 3,246,693 | A | 4/1966 | Crider |
| 3,294,167 | A | 12/1966 | Vogel |
| 3,310,109 | A | 3/1967 | Marx et al. |
| 3,314,476 | A | 4/1967 | Staples et al. |
| 3,315,745 | A | 4/1967 | Rees, Jr. |
| 3,322,194 | A | 5/1967 | Strubbar |
| 3,332,482 | A | 7/1967 | Trantham |
| 3,334,687 | A | 8/1967 | Parker |
| 3,342,257 | A | 9/1967 | Jacobs et al. |
| 3,342,259 | A | 9/1967 | Powell |
| 3,351,132 | A | 11/1967 | Dougan et al. |
| 3,361,201 | A | 1/1968 | Howard |
| 3,363,686 | A | 1/1968 | Gilchrist |
| 3,363,687 | A | 1/1968 | Dean |
| 3,379,246 | A | 4/1968 | Sklar et al. |
| 3,379,248 | A | 4/1968 | Strange |
| 3,406,755 | A | 10/1968 | Sharp |
| 3,411,578 | A | 11/1968 | Holmes |
| 3,412,793 | A | 11/1968 | Needham |
| 3,412,794 | A | 11/1968 | Craighead |
| 3,422,891 | A | 1/1969 | Alexander et al. |
| 3,430,700 | A | 3/1969 | Satter et al. |
| 3,441,083 | A | 4/1969 | Fitzgerald |
| 3,454,958 | A | 7/1969 | Parker |
| 3,456,721 | A | 7/1969 | Smith |
| 3,490,529 | A | 1/1970 | Parker |
| 3,490,531 | A | 1/1970 | Dixon |
| 3,507,330 | A | 4/1970 | Gill |
| 3,547,192 | A | 12/1970 | Claridge et al. |
| 3,554,285 | A | 1/1971 | Meldau |
| 3,605,888 | A | 9/1971 | Crowson et al. |
| 3,608,638 | A | 9/1971 | Terwilliger |
| 3,653,438 | A | 4/1972 | Wagner |
| 3,685,581 | A | 8/1972 | Hess et al. |
| 3,690,376 | A | 9/1972 | Zwicky et al. |
| 3,703,927 | A | 11/1972 | Harry |
| 3,724,043 | A | 4/1973 | Eustance |
| 3,727,686 | A | 4/1973 | Prates et al. |
| 3,759,328 | A | 9/1973 | Ueber et al. |
| 3,771,598 | A | 11/1973 | McBean |
| 3,782,465 | A | 1/1974 | Bell et al. |
| 3,796,262 | A | 3/1974 | Allen et al. |
| 3,804,169 | A | 4/1974 | Closmann |
| 3,805,885 | A | 4/1974 | Van Huisen |
| 3,822,747 | A | 7/1974 | Maguire, Jr. |
| 3,827,495 | A | 8/1974 | Reed |
| 3,837,402 | A | 9/1974 | Stringer |
| 3,838,738 | A | 10/1974 | Redford et al. |
| 3,847,224 | A | 11/1974 | Allen et al. |
| 3,872,924 | A | 3/1975 | Clampitt |
| 3,892,270 | A | 7/1975 | Lindquist |
| 3,905,422 | A | 9/1975 | Woodward |
| 3,929,190 | A | 12/1975 | Chang et al. |
| 3,931,856 | A | 1/1976 | Barnes |
| 3,941,192 | A | 3/1976 | Carlin et al. |
| 3,945,679 | A | 3/1976 | Closmann et al. |
| 3,946,809 | A | 3/1976 | Hagedorn |
| 3,954,139 | A | 5/1976 | Allen |
| 3,958,636 | A | 5/1976 | Perkins |
| 3,964,546 | A | 6/1976 | Allen |
| 3,967,853 | A | 7/1976 | Closmann et al. |
| 3,978,920 | A | 9/1976 | Bandyopadhyay et al. |
| 3,993,133 | A | 11/1976 | Clampitt |
| 3,994,340 | A | 11/1976 | Anderson et al. |
| 3,994,341 | A | 11/1976 | Anderson et al. |
| 3,997,004 | A | 12/1976 | Wu |
| 3,999,606 | A | 12/1976 | Bandyopadhyay et al. |
| 4,004,636 | A | 1/1977 | Brown et al. |
| 4,007,785 | A | 2/1977 | Allen et al. |
| 4,007,791 | A | 2/1977 | Johnson |
| 4,008,765 | A | 2/1977 | Anderson et al. |
| 4,019,575 | A | 4/1977 | Pisio et al. |
| 4,019,578 | A | 4/1977 | Terry et al. |
| 4,020,901 | A | 5/1977 | Pisio et al. |
| 4,022,275 | A | 5/1977 | Brandon |
| 4,022,280 | A | 5/1977 | Stoddard et al. |
| 4,026,358 | A | 5/1977 | Allen |
| 4,033,411 | A | 7/1977 | Goins |
| 4,037,655 | A | 7/1977 | Carpenter |
| 4,037,658 | A | 7/1977 | Anderson |
| 4,049,053 | A | 9/1977 | Fisher et al. |
| 4,066,127 | A | 1/1978 | Harnsberger |
| 4,067,391 | A | 1/1978 | Dewell |
| 4,068,715 | A | 1/1978 | Wu |
| 4,068,717 | A | 1/1978 | Needham |
| 4,078,608 | A | 3/1978 | Allen et al. |
| 4,084,637 | A | 4/1978 | Todd |
| 4,085,799 | A | 4/1978 | Bousaid et al. |
| 4,085,800 | A | 4/1978 | Engle et al. |
| 4,088,188 | A | 5/1978 | Widmyer |
| 4,099,564 | A | 7/1978 | Hutchison |
| 4,114,687 | A | 9/1978 | Payton |
| 4,114,691 | A | 9/1978 | Payton |
| 4,120,357 | A | 10/1978 | Anderson |
| 4,124,071 | A | 11/1978 | Allen et al. |
| 4,129,183 | A | 12/1978 | Kalfoglou |
| 4,129,308 | A | 12/1978 | Hutchison |
| 4,130,163 | A | 12/1978 | Bombardieri |
| 4,133,382 | A | 1/1979 | Cram et al. |
| 4,133,384 | A | 1/1979 | Allen et al. |
| 4,140,180 | A | 2/1979 | Bridges et al. |
| 4,140,182 | A | 2/1979 | Vriend |
| 4,141,415 | A | 2/1979 | Wu et al. |
| 4,144,935 | A | 3/1979 | Bridges et al. |
| RE30,019 | E | 6/1979 | Lindquist |
| 4,160,479 | A | 7/1979 | Richardson et al. |
| 4,160,481 | A | 7/1979 | Turk et al. |
| 4,174,752 | A | 11/1979 | Slater et al. |
| 4,191,252 | A | 3/1980 | Buckley et al. |
| 4,202,168 | A | 5/1980 | Acheson et al. |
| 4,202,169 | A | 5/1980 | Acheson et al. |
| 4,212,353 | A | 7/1980 | Hall |
| 4,217,956 | A | 8/1980 | Goss et al. |
| 4,228,853 | A | 10/1980 | Harvey et al. |
| 4,228,854 | A | 10/1980 | Sacuta |
| 4,228,856 | A | 10/1980 | Reale |
| 4,246,966 | A | 1/1981 | Stoddard et al. |
| 4,248,302 | A | 2/1981 | Churchman |
| 4,249,602 | A | 2/1981 | Burton, III et al. |
| 4,250,964 | A | 2/1981 | Jewell et al. |
| 4,252,194 | A | 2/1981 | Felber et al. |
| 4,257,650 | A | 3/1981 | Allen |

4,260,018 A 4/1981 Shum et al.
4,262,745 A 4/1981 Stewart
4,265,310 A 5/1981 Britton et al.
4,270,609 A 6/1981 Choules
4,271,905 A 6/1981 Redford et al.
4,274,487 A 6/1981 Hollingsworth et al.
4,280,559 A 7/1981 Best
4,282,929 A 8/1981 Krajicek
4,284,139 A 8/1981 Sweany
RE30,738 E 9/1981 Bridges et al.
4,289,203 A 9/1981 Swanson
4,296,814 A 10/1981 Stalder et al.
4,300,634 A 11/1981 Clampitt
4,303,126 A 12/1981 Blevins
4,305,463 A 12/1981 Zakiewicz
4,306,981 A 12/1981 Blair, Jr.
4,319,632 A 3/1982 Marr, Jr.
4,319,635 A 3/1982 Jones
4,325,432 A 4/1982 Henry
4,326,968 A 4/1982 Blair, Jr.
4,327,805 A 5/1982 Poston
4,330,038 A 5/1982 Soukup et al.
4,333,529 A 6/1982 McCorquodale
4,344,483 A 8/1982 Fisher et al.
4,344,485 A 8/1982 Butler
4,344,486 A 8/1982 Parrish
4,345,652 A 8/1982 Roque
4,362,213 A 12/1982 Tabor
4,372,386 A 2/1983 Rhoades et al.
4,379,489 A 4/1983 Rollmann
4,379,592 A 4/1983 Vakhnin et al.
4,380,265 A 4/1983 Mohaupt
4,380,267 A 4/1983 Fox
4,381,124 A 4/1983 Verty et al.
4,382,469 A 5/1983 Bell et al.
4,385,661 A 5/1983 Fox
4,387,016 A 6/1983 Gagon
4,389,320 A 6/1983 Clampitt
4,390,062 A 6/1983 Fox
4,390,067 A 6/1983 Willman
4,392,530 A 7/1983 Odeh et al.
4,393,937 A 7/1983 Dilgren et al.
4,396,063 A 8/1983 Godbey
4,398,602 A 8/1983 Anderson
4,406,499 A 9/1983 Yildirim
4,407,367 A 10/1983 Kydd
4,410,216 A 10/1983 Allen
4,411,618 A 10/1983 Donaldson et al.
4,412,585 A 11/1983 Bouck
4,415,034 A 11/1983 Bouck
4,417,620 A 11/1983 Shafir
4,418,752 A 12/1983 Boyer et al.
4,421,163 A 12/1983 Tuttle
4,423,779 A 1/1984 Livingston
4,427,528 A 1/1984 Lindörfer et al.
4,429,744 A 2/1984 Cook
4,429,745 A 2/1984 Cook
4,434,851 A 3/1984 Haynes, Jr. et al.
4,441,555 A 4/1984 Shu
4,444,257 A 4/1984 Stine
4,444,261 A 4/1984 Islip
4,445,573 A 5/1984 McCaleb
4,448,251 A 5/1984 Stine
4,450,909 A 5/1984 Sacuta
4,450,911 A 5/1984 Shu et al.
4,452,491 A 6/1984 Seglin et al.
4,453,597 A 6/1984 Brown et al.
4,456,065 A 6/1984 Heim et al.
4,456,066 A 6/1984 Shu
4,456,068 A 6/1984 Burrill, Jr. et al.
4,458,756 A 7/1984 Clark
4,458,759 A 7/1984 Isaacs et al.
4,460,044 A 7/1984 Porter
4,463,803 A * 8/1984 Wyatt ..... 166/59
4,465,137 A 8/1984 Sustek, Jr. et al.
4,466,485 A 8/1984 Shu
4,469,177 A 9/1984 Venkatesan
4,471,839 A 9/1984 Snavely et al.
4,473,114 A 9/1984 Bell et al.
4,475,592 A 10/1984 Pachovsky
4,475,595 A 10/1984 Watkins et al.
4,478,280 A 10/1984 Hopkins et al.
4,478,705 A 10/1984 Ganguli
4,480,689 A 11/1984 Wunderlich
4,484,630 A 11/1984 Chung
4,485,868 A 12/1984 Sresty et al.
4,487,262 A 12/1984 Venkatesan et al.
4,487,264 A 12/1984 Hyne et al.
4,488,600 A 12/1984 Fan
4,488,976 A 12/1984 Dilgren et al.
4,491,180 A 1/1985 Brown et al.
4,498,537 A 2/1985 Cook
4,498,542 A 2/1985 Eisenhawer et al.
4,499,946 A 2/1985 Martin et al.
4,501,325 A 2/1985 Frazier et al.
4,501,326 A 2/1985 Edmunds
4,501,445 A 2/1985 Gregoli
4,503,910 A 3/1985 Shu
4,503,911 A 3/1985 Hartman et al.
4,508,170 A 4/1985 Littmann
4,513,819 A 4/1985 Islip et al.
4,515,215 A 5/1985 Hermes et al.
4,516,636 A 5/1985 Doscher
4,522,260 A 6/1985 Wolcott, Jr.
4,522,263 A 6/1985 Hopkins et al.
4,524,826 A 6/1985 Savage
4,528,104 A 7/1985 House et al.
4,530,401 A 7/1985 Hartman et al.
4,532,993 A 8/1985 Dilgren et al.
4,532,994 A 8/1985 Toma et al.
4,535,845 A 8/1985 Brown et al.
4,540,049 A 9/1985 Hawkins et al.
4,540,050 A 9/1985 Huang et al.
4,545,435 A 10/1985 Bridges et al.
4,546,829 A 10/1985 Martin et al.
4,550,779 A 11/1985 Zakiewicz
4,556,107 A 12/1985 Duerksen et al.
4,558,740 A 12/1985 Yellig, Jr.
4,565,245 A 1/1986 Mims et al.
4,565,249 A 1/1986 Pebdani et al.
4,572,296 A 2/1986 Watkins
4,574,884 A 3/1986 Schmidt
4,574,886 A 3/1986 Hopkins et al.
4,577,688 A 3/1986 Gassmann et al.
4,579,176 A 4/1986 Davies et al.
4,589,487 A 5/1986 Venkatesan et al.
4,595,057 A 6/1986 Deming et al.
4,597,441 A 7/1986 Ware et al.
4,597,443 A 7/1986 Shu et al.
4,598,770 A 7/1986 Shu et al.
4,601,337 A 7/1986 Lau et al.
4,601,338 A 7/1986 Prats et al.
4,607,695 A 8/1986 Weber
4,607,699 A 8/1986 Stephens
4,607,700 A 8/1986 Duerksen et al.
4,610,304 A 9/1986 Doscher
4,612,989 A 9/1986 Rakach et al.
4,612,990 A 9/1986 Shu
4,615,391 A 10/1986 Garthoffner
4,620,592 A 11/1986 Perkins
4,620,593 A 11/1986 Haagensen
4,635,720 A 1/1987 Chew
4,637,461 A 1/1987 Hight
4,637,466 A 1/1987 Hawkins et al.
4,640,352 A 2/1987 Vanmeurs et al.
4,640,359 A 2/1987 Livesey et al.

4,641,710 A 2/1987 Klinger
4,645,003 A 2/1987 Huang et al.
4,645,004 A 2/1987 Bridges et al.
4,646,824 A 3/1987 Huang et al.
4,648,835 A 3/1987 Eisenhawer et al.
4,651,825 A 3/1987 Wilson
4,651,826 A 3/1987 Holmes
4,653,583 A 3/1987 Huang et al.
4,662,438 A 5/1987 Taflove et al.
4,662,440 A 5/1987 Harmon et al.
4,662,441 A 5/1987 Huang et al.
4,665,989 A 5/1987 Wilson
4,667,739 A 5/1987 Van Meurs et al.
4,676,313 A 6/1987 Rinaldi
4,679,626 A 7/1987 Perkins
4,682,652 A 7/1987 Huang et al.
4,682,653 A 7/1987 Angstadt
4,685,515 A 8/1987 Huang et al.
4,687,058 A 8/1987 Casad et al.
4,690,215 A 9/1987 Roberts et al.
4,691,773 A 9/1987 Ward et al.
4,693,311 A 9/1987 Muijs et al.
4,694,907 A 9/1987 Stahl et al.
4,697,642 A 10/1987 Vogel
4,699,213 A 10/1987 Fleming
4,700,779 A 10/1987 Huang et al.
4,702,314 A 10/1987 Huang et al.
4,702,317 A 10/1987 Shen
4,705,108 A 11/1987 Little et al.
4,706,751 A 11/1987 Gondouin
4,707,230 A 11/1987 Ajami
4,718,485 A 1/1988 Brown et al.
4,718,489 A 1/1988 Hallam et al.
4,727,489 A 2/1988 Frazier et al.
4,727,937 A 3/1988 Shum et al.
4,739,831 A 4/1988 Settlemeyer et al.
4,753,293 A 6/1988 Bohn
4,756,369 A 7/1988 Jennings, Jr. et al.
4,757,833 A 7/1988 Danley
4,759,571 A 7/1988 Stone et al.
4,766,958 A 8/1988 Faecke
4,769,161 A 9/1988 Angstadt
4,775,450 A 10/1988 Ajami
4,782,901 A 11/1988 Phelps et al.
4,785,028 A 11/1988 Hoskin et al.
4,785,883 A 11/1988 Hoskin et al.
4,787,452 A 11/1988 Jennings, Jr.
4,793,415 A 12/1988 Holmes et al.
4,804,043 A 2/1989 Shu et al.
4,809,780 A 3/1989 Shen
4,813,483 A 3/1989 Ziegler
4,817,711 A 4/1989 Jeambey
4,817,714 A 4/1989 Jones
4,818,370 A 4/1989 Gregoli et al.
4,828,030 A 5/1989 Jennings, Jr.
4,828,031 A 5/1989 Davis
4,828,032 A 5/1989 Teletzke et al.
4,834,174 A 5/1989 Vandevier
4,834,179 A 5/1989 Kokolis et al.
4,844,155 A 7/1989 Megyeri et al.
4,846,275 A 7/1989 McKay
4,850,429 A 7/1989 Mims et al.
4,856,586 A 8/1989 Phelps et al.
4,856,587 A 8/1989 Nielson
4,860,827 A 8/1989 Lee et al.
4,861,263 A 8/1989 Schirmer
4,867,238 A 9/1989 Bayless et al.
4,869,830 A 9/1989 Konak et al.
4,874,043 A 10/1989 Joseph et al.
4,884,635 A 12/1989 McKay et al.
4,886,118 A 12/1989 Van Meurs et al.
4,892,146 A 1/1990 Shen
4,895,085 A 1/1990 Chips
4,895,206 A 1/1990 Price
4,896,725 A 1/1990 Parker et al.
4,901,795 A 2/1990 Phelps et al.
4,903,766 A 2/1990 Shu
4,903,768 A 2/1990 Shu
4,903,770 A 2/1990 Friedman et al.
4,915,170 A 4/1990 Hoskin
4,919,206 A 4/1990 Freeman et al.
4,926,941 A 5/1990 Glandt et al.
4,926,943 A 5/1990 Hoskin
4,928,766 A 5/1990 Hoskin
4,930,454 A 6/1990 Latty et al.
4,940,091 A 7/1990 Shu et al.
4,945,984 A 8/1990 Price
4,947,933 A 8/1990 Jones et al.
4,961,467 A 10/1990 Pebdani
4,962,814 A 10/1990 Alameddine
4,964,461 A 10/1990 Shu
4,966,235 A 10/1990 Gregoli et al.
4,969,520 A 11/1990 Jan et al.
4,974,677 A 12/1990 Shu
4,982,786 A 1/1991 Jennings, Jr.
4,983,364 A 1/1991 Buck et al.
4,988,389 A * 1/1991 Adamache et al. ..... 166/302
4,991,652 A 2/1991 Hoskin et al.
5,010,953 A 4/1991 Friedman et al.
5,013,462 A 5/1991 Danley
5,014,787 A 5/1991 Duerksen
5,016,709 A 5/1991 Combe et al.
5,016,710 A 5/1991 Renard et al.
5,016,713 A 5/1991 Sanchez et al.
5,024,275 A 6/1991 Anderson et al.
5,027,898 A 7/1991 Naae
5,036,915 A 8/1991 Wyganowski
5,036,917 A 8/1991 Jennings, Jr. et al.
5,036,918 A 8/1991 Jennings, Jr. et al.
5,040,605 A 8/1991 Showalter
5,042,579 A 8/1991 Glandt et al.
5,046,559 A 9/1991 Glandt
5,046,560 A 9/1991 Teletzke et al.
5,052,482 A 10/1991 Gondouin
5,054,551 A 10/1991 Duerksen
5,056,596 A 10/1991 McKay et al.
5,058,681 A 10/1991 Reed
5,060,726 A 10/1991 Glandt et al.
5,065,819 A 11/1991 Kasevich
5,083,612 A 1/1992 Ashrawi
5,083,613 A 1/1992 Gregoli et al.
5,085,275 A 2/1992 Gondouin
5,099,918 A 3/1992 Bridges et al.
5,101,898 A 4/1992 Hong
5,105,880 A 4/1992 Shen
5,109,927 A 5/1992 Supernaw et al.
5,123,485 A 6/1992 Vasicek et al.
5,131,471 A 7/1992 Duerksen et al.
5,145,002 A 9/1992 McKay
5,145,003 A 9/1992 Duerksen
5,148,869 A 9/1992 Sanchez
5,156,214 A 10/1992 Hoskin et al.
5,167,280 A 12/1992 Sanchez et al.
5,172,763 A 12/1992 Mohammadi et al.
5,174,377 A 12/1992 Kumar
5,178,217 A 1/1993 Mohammadi et al.
5,186,256 A 2/1993 Downs
5,199,490 A 4/1993 Surles et al.
5,201,815 A 4/1993 Hong et al.
5,215,146 A 6/1993 Sanchez
5,215,149 A 6/1993 Lu
5,236,039 A 8/1993 Edelstein et al.
5,238,066 A 8/1993 Beattie et al.
5,246,071 A 9/1993 Chu
5,247,993 A 9/1993 Sarem et al.
5,252,226 A 10/1993 Justice 5,271,693 A 12/1993 Johnson et al.
5,273,111 A 12/1993 Brannan et al.
5,277,830 A 1/1994 Hoskin et al.
5,279,367 A 1/1994 Osterloh
5,282,508 A 2/1994 Ellingsen et al.
5,289,881 A 3/1994 Schuh
5,293,936 A 3/1994 Bridges
5,295,540 A 3/1994 Djabbarah et al.
5,297,627 A 3/1994 Sanchez et al.
5,305,209 A 4/1994 Stein et al.
5,305,829 A 4/1994 Kumar
5,318,124 A 6/1994 Ong et al.
5,325,918 A 7/1994 Berryman et al.
5,339,897 A 8/1994 Leaute
5,339,898 A 8/1994 Yu et al.
5,339,904 A 8/1994 Jennings, Jr. et al.
5,350,014 A 9/1994 McKay
5,358,054 A 10/1994 Bert
5,361,845 A 11/1994 Jamaluddin et al.
5,377,757 A 1/1995 Ng
5,404,950 A 4/1995 Ng et al.
5,407,009 A 4/1995 Butler et al.
5,411,086 A 5/1995 Burcham et al.
5,411,089 A 5/1995 Vinegar et al.
5,411,094 A 5/1995 Northrop
5,413,175 A 5/1995 Edmunds
5,415,231 A 5/1995 Northrop et al.
5,417,283 A 5/1995 Ejiogu et al.
5,431,224 A 7/1995 Laali
5,433,271 A 7/1995 Vinegar et al.
5,449,038 A 9/1995 Horton et al.
5,450,902 A 9/1995 Matthews
5,456,315 A 10/1995 Kisman et al.
5,458,193 A 10/1995 Horton et al.
5,464,309 A 11/1995 Mancini et al.
5,483,801 A 1/1996 Craze
5,503,226 A 4/1996 Wadleigh
5,511,616 A 4/1996 Bert
5,513,705 A 5/1996 Djabbarah et al.
5,531,272 A 7/1996 Ng et al.
5,534,186 A 7/1996 Walker et al.
5,547,022 A 8/1996 Juprasert et al.
5,553,974 A 9/1996 Nazarian
5,560,737 A 10/1996 Schuring et al.
5,565,139 A 10/1996 Walker et al.
5,589,775 A 12/1996 Kuckes
5,607,016 A 3/1997 Butler
5,607,018 A 3/1997 Schuh
5,626,191 A 5/1997 Greaves et al.
5,626,193 A 5/1997 Nzekwu et al.
5,635,139 A 6/1997 Holst et al.
5,650,128 A 7/1997 Holst et al.
5,660,500 A 8/1997 Marsden, Jr. et al.
5,677,267 A 10/1997 Suarez et al.
5,682,613 A 11/1997 Dinatale
5,709,505 A 1/1998 Williams et al.
5,713,415 A 2/1998 Bridges
5,738,937 A 4/1998 Baychar
5,765,964 A 6/1998 Calcote et al.
5,771,973 A 6/1998 Jensen et al.
5,788,412 A 8/1998 Jatkar
RE35,891 E 9/1998 Jamaluddin et al.
5,803,171 A 9/1998 McCaffery et al.
5,803,178 A 9/1998 Cain
5,813,799 A 9/1998 Calcote et al.
5,823,631 A 10/1998 Herbolzheimer et al.
5,860,475 A 1/1999 Ejiogu et al.
5,899,274 A 5/1999 Frauenfeld et al.
5,923,170 A 7/1999 Kuckes
5,931,230 A 8/1999 Lesage et al.
5,941,081 A 8/1999 Burgener
5,957,202 A 9/1999 Huang
5,984,010 A 11/1999 Elias et al.
6,000,471 A 12/1999 Langset
6,004,451 A 12/1999 Rock et al.
6,012,520 A 1/2000 Yu et al.
6,015,015 A 1/2000 Luft et al.
6,016,867 A 1/2000 Gregoli et al.
6,016,868 A 1/2000 Gregoli et al.
6,026,914 A 2/2000 Adams et al.
6,039,121 A 3/2000 Kisman
6,048,810 A 4/2000 Baychar
6,050,335 A 4/2000 Parsons
6,056,057 A 5/2000 Vinegar et al.
6,102,122 A 8/2000 de Rouffignac
6,109,358 A 8/2000 McPhee et al.
6,148,911 A 11/2000 Gipson et al.
6,158,510 A 12/2000 Bacon et al.
6,158,513 A 12/2000 Nistor et al.
6,167,966 B1 1/2001 Ayasse et al.
6,173,775 B1 1/2001 Elias et al.
6,186,232 B1 2/2001 Isaacs et al.
6,189,611 B1 2/2001 Kasevich
6,205,289 B1 3/2001 Kobro
6,230,814 B1 5/2001 Nasr et al.
6,257,334 B1 7/2001 Cyr et al.
6,263,965 B1 7/2001 Schmidt et al.
6,266,619 B1 7/2001 Thomas et al.
6,276,457 B1 8/2001 Moffatt et al.
6,285,014 B1 9/2001 Beck et al.
6,305,472 B2 10/2001 Richardson et al.
6,318,464 B1 11/2001 Mokrys
6,325,147 B1 12/2001 Doerler et al.
6,328,104 B1 12/2001 Graue
6,353,706 B1 3/2002 Bridges
6,356,844 B2 3/2002 Thomas et al.
6,357,526 B1 3/2002 Abdel-Halim et al.
6,409,226 B1 6/2002 Slack et al.
6,412,557 B1 7/2002 Ayasse et al.
6,413,016 B1 7/2002 Nelson et al.
6,454,010 B1 9/2002 Thomas et al.
6,536,523 B1 3/2003 Kresnyak et al.
6,543,537 B1 * 4/2003 Kjos ..... 166/266
6,554,067 B1 4/2003 Davies et al.
6,561,274 B1 5/2003 Hayes et al.
6,581,684 B2 6/2003 Wellington et al.
6,588,500 B2 7/2003 Lewis
6,591,906 B2 7/2003 Wellington et al.
6,591,908 B2 7/2003 Nasr
6,607,036 B2 8/2003 Ranson et al.
6,631,761 B2 10/2003 Yuan et al.
6,662,872 B2 12/2003 Gutek et al.
6,666,666 B1 12/2003 Gilbert et al.
6,681,859 B2 1/2004 Hill
6,688,387 B1 2/2004 Wellington et al.
6,702,016 B2 3/2004 de Rouffignac et al.
6,708,759 B2 3/2004 Leaute et al.
6,712,136 B2 3/2004 de Rouffignac et al.
6,712,150 B1 3/2004 Misselbrook et al.
6,715,546 B2 4/2004 Vinegar et al.
6,715,547 B2 4/2004 Vinegar et al.
6,715,548 B2 4/2004 Wellington et al.
6,715,549 B2 4/2004 Wellington et al.
6,719,047 B2 4/2004 Fowler et al.
6,722,429 B2 4/2004 de Rouffignac et al.
6,722,431 B2 4/2004 Karanikas et al.
6,725,920 B2 4/2004 Zhang et al.
6,729,394 B1 5/2004 Hassan et al.
6,729,395 B2 5/2004 Shahin, Jr. et al.
6,729,397 B2 5/2004 Zhang et al.
6,729,401 B2 5/2004 Vinegar et al.
6,732,794 B2 5/2004 Wellington et al.
6,732,795 B2 5/2004 de Rouffignac et al.
6,732,796 B2 5/2004 Vinegar et al.
6,733,636 B1 5/2004 Heins
6,736,215 B2 5/2004 Maher et al.

6,736,222 B2 5/2004 Kuckes et al.
6,739,394 B2 5/2004 Vinegar et al.
6,742,588 B2 6/2004 Wellington et al.
6,742,593 B2 6/2004 Vinegar et al.
6,745,831 B2 6/2004 de Rouffignac et al.
6,745,832 B2 6/2004 Wellington et al.
6,745,837 B2 6/2004 Wellington et al.
6,755,246 B2 6/2004 Chen et al.
6,758,268 B2 7/2004 Vinegar et al.
6,782,947 B2 8/2004 de Rouffignac et al.
6,789,625 B2 9/2004 de Rouffignac et al.
6,794,864 B2 9/2004 Mirotchnik et al.
6,805,195 B2 10/2004 Vinegar et al.
6,814,141 B2 11/2004 Huh et al.
6,853,921 B2 2/2005 Thomas et al.
7,079,952 B2 7/2006 Thomas et al.
2001/0009830 A1 7/2001 Baychar
2001/0017206 A1 8/2001 Davidson et al.
2001/0018975 A1 9/2001 Richardson et al.
2002/0016679 A1 2/2002 Thomas et al.
2002/0029881 A1 3/2002 de Rouffignac et al.
2002/0033253 A1 3/2002 Rouffignac et al.
2002/0038710 A1 4/2002 Maher et al.
2002/0040779 A1 4/2002 Wellington et al.
2002/0046838 A1 4/2002 Karanikas et al.
2002/0056551 A1 5/2002 Wellington et al.
2002/0104651 A1 8/2002 McClung, III
2002/0148608 A1 10/2002 Shaw
2002/0157831 A1 10/2002 Kurlenya et al.
2003/0000711 A1 1/2003 Gutek et al.
2003/0009297 A1 1/2003 Mirotchnik et al.
2003/0015458 A1 1/2003 Nenniger et al.
2003/0042018 A1 3/2003 Huh et al.
2003/0044299 A1 3/2003 Thomas et al.
2003/0051875 A1 3/2003 Wilson
2003/0062159 A1 4/2003 Nasr
2003/0062717 A1 4/2003 Thomas et al.
2003/0079877 A1 5/2003 Wellington et al.
2003/0080604 A1 5/2003 Vinegar et al.
2003/0090424 A1 5/2003 Brune et al.
2003/0098605 A1 5/2003 Vinegar et al.
2003/0102123 A1 6/2003 Wittle et al.
2003/0102124 A1 6/2003 Vinegar et al.
2003/0102126 A1 6/2003 Sumnu-Dindoruk et al.
2003/0102130 A1 6/2003 Vinegar et al.
2003/0110017 A1 6/2003 Guthrie et al.
2003/0111223 A1 6/2003 Rouffignac et al.
2003/0116315 A1 6/2003 Wellington et al.
2003/0127226 A1 7/2003 Heins
2003/0129895 A1 7/2003 Baychar
2003/0131993 A1 7/2003 Zhang et al.
2003/0131994 A1 7/2003 Vinegar et al.
2003/0131995 A1 7/2003 de Rouffignac et al.
2003/0131996 A1 7/2003 Vinegar et al.
2003/0136476 A1 7/2003 O'Hara et al.
2003/0141053 A1 7/2003 Yuan et al.
2003/0141065 A1 7/2003 Karanikas et al.
2003/0141066 A1 7/2003 Karanikas et al.
2003/0141067 A1 7/2003 Rouffignac et al.
2003/0141068 A1 7/2003 Pierre de Rouffignac et al.
2003/0155111 A1 8/2003 Vinegar et al.
2003/0159828 A1 8/2003 Howard et al.
2003/0164234 A1 9/2003 de Rouffignac et al.
2003/0164239 A1 9/2003 Wellington et al.
2003/0173072 A1 9/2003 Vinegar et al.
2003/0173080 A1 9/2003 Berchenko et al.
2003/0173081 A1 9/2003 Vinegar et al.
2003/0173082 A1 9/2003 Vinegar et al.
2003/0173086 A1 9/2003 Howard et al.
2003/0178191 A1 9/2003 Maher et al.
2003/0183390 A1 10/2003 Veenstra et al.
2003/0192691 A1 10/2003 Vinegar et al.
2003/0192693 A1 10/2003 Wellington
2003/0196788 A1 10/2003 Vinegar et al.
2003/0196789 A1 10/2003 Wellington et al.
2003/0196801 A1 10/2003 Vinegar et al.
2003/0196810 A1 10/2003 Vinegar et al.
2003/0201098 A1 10/2003 Karanikas et al.
2003/0205378 A1 11/2003 Wellington et al.
2003/0209348 A1 11/2003 Ward et al.
2003/0223896 A1 12/2003 Gilbert et al.
2004/0007500 A1 1/2004 Kresnyak
2004/0020642 A1 2/2004 Vinegar et al.
2004/0040715 A1 3/2004 Wellington et al.
2004/0050547 A1 3/2004 Limbach
2004/0112586 A1 6/2004 Matthews et al.
2004/0116304 A1 6/2004 Wu et al.
2004/0118783 A1 6/2004 Myers et al.
2004/0140095 A1 7/2004 Vinegar et al.
2004/0140096 A1 7/2004 Sandberg et al.
2004/0144540 A1 7/2004 Sandberg et al.
2004/0144541 A1 7/2004 Picha et al.
2004/0145969 A1 7/2004 Bai et al.
2004/0146288 A1 7/2004 Vinegar et al.
2004/0154793 A1 8/2004 Zapadinski
2004/0177966 A1 9/2004 Vinegar et al.
2004/0204324 A1 10/2004 Baltoiu et al.
2004/0211554 A1 10/2004 Vinegar et al.
2004/0211569 A1 10/2004 Vinegar et al.
2004/0261729 A1 12/2004 Sarkar
2005/0006097 A1 1/2005 Sandberg et al.
2005/0026094 A1 2/2005 Sanmiguel et al.
2005/0038603 A1 2/2005 Thomas et al.
2006/0005968 A1* 1/2006 Vinegar et al. ..... 166/302
2006/0175061 A1* 8/2006 Crichlow ..... 166/302

FOREIGN PATENT DOCUMENTS

EP 0 088 376 A2 9/1983
EP 0 144 203 A2 6/1985
EP 0 158 486 A1 10/1985
EP 0 226 275 A1 6/1987
EP 0 261 793 A1 3/1988
EP 0 269 231 A1 6/1988
EP 0 283 602 A1 9/1988
EP 0 295 712 A2 12/1988
EP 0 341 976 A2 11/1989
EP 0 387 846 A1 9/1990
EP 0 420 656 A2 4/1991
EP 0 747 142 A1 12/1996
FR 2 852 713 9/2004
GB 1 457 696 12/1976
GB 1 463 444 2/1977
GB 2 031 975 4/1980
GB 1 585 742 3/1981
GB 2 062 065 5/1981
GB 2 138 869 10/1984
GB 2 156 400 10/1985
GB 2 164 978 4/1986
GB 2 177 141 1/1987
GB 2 196 665 5/1988
GB 2 219 818 12/1989
GB 2 257 184 1/1993
GB 2 272 465 5/1994
GB 2 286 001 8/1995
GB 2 340 152 2/2000
GB 2 357 528 6/2001
GB 2 362 333 11/2001
GB 2 363 587 1/2002
GB 2 391 890 2/2004
GB 2 391 891 2/2004
GB 2 403 443 12/2004
WO WO 82/01214 4/1982
WO WO 86/03251 6/1986
WO WO 87/07293 12/1987
WO WO 89/12728 12/1989

| | | | |
|---|---|---|---|
| WO | WO 92/18748 | | 10/1992 |
| WO | WO 93/16338 | | 8/1993 |
| WO | WO 93/23134 | | 11/1993 |
| WO | WO 94/21886 | | 9/1994 |
| WO | WO 94/21889 | | 9/1994 |
| WO | WO 95/16512 | | 6/1995 |
| WO | WO 96/16729 | | 6/1996 |
| WO | WO 96/32566 | | 10/1996 |
| WO | WO 96/35858 | | 11/1996 |
| WO | WO 97/01017 | | 1/1997 |
| WO | WO 97/12119 | | 4/1997 |
| WO | WO 97/35090 | | 9/1997 |
| WO | WO 98/04807 | | 2/1998 |
| WO | WO 98/37306 | | 8/1998 |
| WO | WO 98/40603 | | 9/1998 |
| WO | WO 98/40605 | | 9/1998 |
| WO | WO 98/45733 | | 10/1998 |
| WO | WO 98/50679 | | 11/1998 |
| WO | WO 99/30002 | | 6/1999 |
| WO | WO 99/67503 | | 12/1999 |
| WO | WO 99/67504 | | 12/1999 |
| WO | WO 99/67505 | | 12/1999 |
| WO | WO 00/23688 | | 4/2000 |
| WO | WO 00/25002 | | 5/2000 |
| WO | WO 00/66882 | | 11/2000 |
| WO | WO 00/67930 | | 11/2000 |
| WO | WO 01/06089 | A1 | 1/2001 |
| WO | WO 01/27439 | A1 | 4/2001 |
| WO | WO 01/62603 | A2 | 8/2001 |
| WO | WO 01/81239 | A2 | 11/2001 |
| WO | WO 01/81505 | A1 | 11/2001 |
| WO | WO 01/81710 | A1 | 11/2001 |
| WO | WO 01/81715 | A2 | 11/2001 |
| WO | WO 01/92673 | A2 | 12/2001 |
| WO | WO 01/92684 | A1 | 12/2001 |
| WO | WO 01/92768 | A2 | 12/2001 |
| WO | WO 02/086018 | A2 | 10/2002 |
| WO | WO 02/086276 | A2 | 10/2002 |
| WO | WO 03/010415 | A1 | 2/2003 |
| WO | WO 03/036033 | A1 | 5/2003 |
| WO | WO 03/036038 | A2 | 5/2003 |
| WO | WO 03/036039 | A1 | 5/2003 |
| WO | WO 03/036043 | A2 | 5/2003 |
| WO | WO 03/038230 | A2 | 5/2003 |
| WO | WO 03/038233 | A1 | 5/2003 |
| WO | WO 03/040513 | A2 | 5/2003 |
| WO | WO 03/040762 | A1 | 5/2003 |
| WO | WO 03/053603 | A2 | 7/2003 |
| WO | WO 03/054351 | A1 | 7/2003 |
| WO | WO 03/062596 | A1 | 7/2003 |
| WO | WO 03/100257 | A1 | 12/2003 |
| WO | WO 2004/038173 | A1 | 5/2004 |
| WO | WO 2004/038174 | A2 | 5/2004 |
| WO | WO 2004/038175 | A1 | 5/2004 |
| WO | WO 2004/050567 | A1 | 6/2004 |
| WO | WO 2004/050791 | A1 | 6/2004 |
| WO | WO 2004/097159 | A2 | 11/2004 |
| WO | WO 2005/007776 | A1 | 1/2005 |
| WO | WO 2005/012688 | A1 | 2/2005 |
| WO | WO 2006/003118 | A1 | 1/2006 |

OTHER PUBLICATIONS

"Downhole Steam-Generator Study, vol. 1, Conception and Feasibility Evaluation, Final Report, Sep. 1978-Sep. 1980," National Technical Information Service, DE82018348, Sandia National Labs, Albuquerque, NM, U.S. Department of Commerce, Jun. 1982, 256 pages.

K.C. Hong, "Recent Advances in Steamflood Technology," SPE 54078, Copyright 1999, Society of Petroleum Engineers, Inc., 14 pages.

Gary R. Greaser and J. Raul Ortiz, "New Thermal Recovery Technology and Technology Transfer for Successful Heavy Oil Development," SPE 69731, Copyright 2003, Society of Petroleum Engineers, Inc., 7 pages.

A.J. Mulac, J.A. Beyeloer, R.G. Clay, K.R. Darnall, A.B. Donaldson, T.D. Donham, R.L. Fox, D.R. Johnson and R.L. Maxwell, "Project Deep Steam Preliminary Field Test Bakersfield, California," SAND80-2843, Printed Apr. 1981, 62 pages.

Presentation by Daulat D. Mamora, "*Thermal Oil Recovery Research at Texas A&M in the Past Five Years—an Overview*," Crisman Institute Halliburton Center for Unconventional Resources, Research Meeting Aug. 3, 2006, Department of Petroleum Engineering, Texas A&M University (13 pages).

Presentation by Namit J. Jaiswal, "*Experimental and Analytical Studies of Hydrocarbon Yields Under Dry-, Steam-, and Steam with Propane-Distillation*," Crisman Institute's Halliburton Center for Unconventional Resources, Aug. 3, 2006, Department of Petroleum Engineering, Texas A&M University, 5 pages.

Presentation by Jose A. Rivero, "*An Experimental Study of Steam and Steam-Propane Injection Using a Novel Smart Horizontal Producer to Enhance Oil Production in the San Ardo Field*," Sponsor's Meeting, Crisman Institute, Aug. 3, 2006, Department of Petroleum Engineering, Texas A&M University, 7 pages.

National Energy Board, "*Canada's Oil Sands: Opportunities and Challenges to 2015*," An Energy Market Assessment, May 2004, 158 pages.

X. Deng, "*Recovery Performance and Economics of Steam/Propane Hybrid Process*," SPE/PS-CIM/CHOA 97760, PS2005-341, SPE/PS-CIM/CHOA International Thermal Operations and Heavy Oil Symposium, copyright 2005, pp. 1-7.

Website: http://www.oceaneering.com/Brochures/MFX%20-%Oceaneering%20Multiflex.pdf, Oceaneering Multiflex, Oceaneering International, Incorporated, printed Nov. 23, 2005, 2 pages.

Notification of Transmittal of the International Search Report and the Written Opinion of the International Searching Authority, or the Declaration, Form PCT/ISA/220; International Search Report, Form PCT/ISA/210; and Written Opinion for PCT/US2007/000782, Form PCT/ISA/237, mailed Jun. 4, 2007, 17 pages.

Notification of Transmittal of the International Search Report and the Written Opinion of the International Searching Authority, or the Declaration, International Search Report, and Written Opinion of the International Searching Authority for International Application No. PCT/US2006/031802 dated Dec. 15, 2006, 13 pages.

International Search Report dated Jan. 9, 2008.

* cited by examiner

PRODUCING RESOURCES USING STEAM INJECTION

TECHNICAL FIELD

This invention relates to resource production, and more particularly to resource production using heated fluid injection into a subterranean zone.

BACKGROUND

Fluids in hydrocarbon formations may be accessed via well bores that extend down into the ground toward the targeted formations. In some cases, fluids in the hydrocarbon formations may have a low enough viscosity that crude oil flows from the formation, through production tubing, and toward the production equipment at the ground surface. Some hydrocarbon formations comprise fluids having a higher viscosity, which may not freely flow from the formation and through the production tubing. These high viscosity fluids in the hydrocarbon formations are occasionally referred to as "heavy oil deposits." In the past, the high viscosity fluids in the hydrocarbon formations remained untapped due to an inability to economically recover them. More recently, as the demand for crude oil has increased, commercial operations have expanded to the recovery of such is 5 heavy oil deposits.

In some circumstances, the application of heated fluids (e.g., steam) and/or solvents to the hydrocarbon formation may reduce the viscosity of the fluids in the formation so as to permit the extraction of crude oil and other liquids from the formation. The design of systems to deliver the steam to the hydrocarbon formations may be affected by a number of factors.

In some cyclical steam injection and producing operations, a dedicated steam injection string is installed in a well bore and used for injecting heated fluid into a target formation during a steam injection cycle to reduce the viscosity of oil in the target formation. Once a steam injection cycle is completed, the injection assembly is removed from the well bore and a production string including an artificial lift assembly is installed on the well bore to produce the well. At some point, the reservoir temperature cools to a point at which increasing viscosity of the oil significantly inhibits reservoir fluid recovery using artificial lift means. Once this happens, the production string is removed from the well bore and the steam injection string is reinstalled to begin next steam injection cycle.

SUMMARY

Systems and methods of producing fluids from a subterranean zone can include downhole fluid heaters (including steam generators) in conjunction with artificial lift systems such as pumps (e.g., electric submersible, progressive cavity, and others), gas lift systems, and other devices. Supplying heated fluid from the downhole fluid heater(s) to a target subterranean zone such as a hydrocarbon-bearing formation or reservoir can reduce the viscosity of oil and/or other fluids in the target formation. To enhance this process of combining artificial lift systems with downhole fluid heaters, a downhole cooling system can be deployed for cooling the artificial lift system and other components of a completion system.

In one aspect, systems for producing fluids from a subterranean zone include: a downhole fluid lift system adapted to be at least partially disposed in the well bore, the downhole fluid lift system operable to lift fluids towards a ground surface; a downhole fluid heater adapted to be disposed in the well bore, the downhole fluid heater operable to vaporize a liquid in the well bore; and a seal between the downhole fluid lift system and the downhole fluid heater, the seal operable to selectively seal with the well bore and isolate a portion of the well bore containing the downhole fluid lift system from a portion of the well bore containing the downhole fluid heater.

In another aspect, systems include: a pump with a pump inlet, the pump inlet disposed in the well bore, the pump operable to lift fluids towards the ground surface; and a downhole fluid heater disposed in the well bore, the downhole fluid heater operable to vaporize a liquid in the well bore.

In one aspect, a method includes: with an artificial lift system in a well bore, introducing heated fluid into a subterranean zone about the well bore; and artificially lifting fluids from the subterranean zone to a ground surface using the artificial lift system.

In one aspect, a method includes artificially lifting fluids from a subterranean zone through a well bore while a downhole heated fluid generator resides in the well bore.

Such systems can include one or more of the following features.

In some embodiments, the downhole fluid lift system includes a gas lift system.

In some embodiments, the downhole fluid lift system includes a pump (e.g., an electric submersible pump). In some cases, the pump is adapted to circulate fluids. In some embodiments, systems also include a surface pump.

In some embodiments, the downhole fluid lift systems are adapted to circulate fluids in the portion of the well bore containing the downhole fluid lift system while isolated from the portion of the well bore containing the downhole fluid heater. In some embodiments, systems can also include a surface pump adapted to circulate fluids in the portion of the well bore containing the downhole fluid lift system while isolated from the portion of the well bore containing the downhole fluid heater.

In some embodiments, the downhole fluid heater includes a steam generator.

In some embodiments, systems also include a tubing string disposed in a well bore, the tubing string adapted to communicate fluids from the subterranean zone to a ground surface.

In some embodiments, systems also include a seal between the pump inlet and the downhole fluid heater such that fluid flow between a portion of the well bore containing the pump inlet and a portion of the well bore containing the downhole fluid heater is limited by the seal.

In some embodiments, methods also include isolating a portion of the well bore containing the artificial lift system from a portion where the heated fluid is being introduced into the subterranean zone.

In some embodiments, methods also include circulating fluid in the portion of the well bore containing the artificial lift system while introducing heated fluid into the subterranean zone. In some instances, circulating fluid comprises circulating fluid using the artificial lift system. In some instances, circulating fluid comprises circulating fluid using a surface pump.

In some embodiments, methods also include cooling a downhole pump present in the well bore while vapor is being generated.

In some embodiments, methods also include heating the fluid in the well bore.

Systems and methods based on downhole fluid heating can improve the efficiencies of heavy oil recovery relative to conventional, surface based, fluid heating by reducing the energy or heat loss during transit of the heated fluid to the target subterranean zones. Some instances, this can reduce the fuel consumption required for heated fluid generation.

In addition, by heating fluid downhole, the injection assembly between the surface and the downhole fluid heating device is no longer used as a conduit for the conveyance of heated fluid into the subterranean zone. Thus, a multipurpose completion assembly can be deployed which provides heated fluid injection into the subterranean zone and a producing conduit to the surface which includes an artificial lift system. Heating the fluids downhole reduces collateral heating of the uphole well bore, thereby reducing heat effects and possible damage on the artificial lift production system and other equipment therein. In addition, multipurpose completion assemblies including cooling mechanisms for downhole artificial lift systems and other devices can further reduce the possibility that heat associated with heating the fluid will damage artificial lift systems or other devices present in the well bore.

Use of multipurpose completion assemblies can also increase operational efficiencies. Such multipurpose completion assemblies can be installed in a well bore and remain in place during both injection and production phases of a cyclic production process. This reduces the number of trips in and out of the well bore that would otherwise be required for systems and methods based on the use of separate injection and production assemblies.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Systems and methods of producing fluids from a subterranean zone can include downhole fluid heaters in conjunction with artificial lift systems. One type of downhole fluid heater is a downhole steam generator that generates heated steam or steam and heated liquid. Although "steam" typically refers to vaporized water, a downhole steam generator can operate to heat and/or vaporize other liquids in addition to, or as an alternative to, water. Some examples of artificial lift systems include pumps, such as electric submersible, progressive cavity, and others, gas lift systems, and other devices that operate to move fluids. Supplying heated fluid from the downhole fluid heater(s) to a target formation such as, a hydrocarbon-bearing formation or reservoir can reduce the viscosity of oil and/or other fluids in the target formation. To accomplish this process of combining artificial lift systems with downhole fluid heaters, a downhole cooling system can be deployed for cooling the artificial lift system and other components of a completion system. In some instances, use of a single multipurpose completion assembly allows for cyclical steam injection and production without disturbing or removing the well bore completion assembly. Such multipurpose completion assemblies can include a downhole heated fluid generator, an artificial lift system, and a production assembly cooling system that circulates surface cooled well bore water during the steam injection process.

Figure 1A:
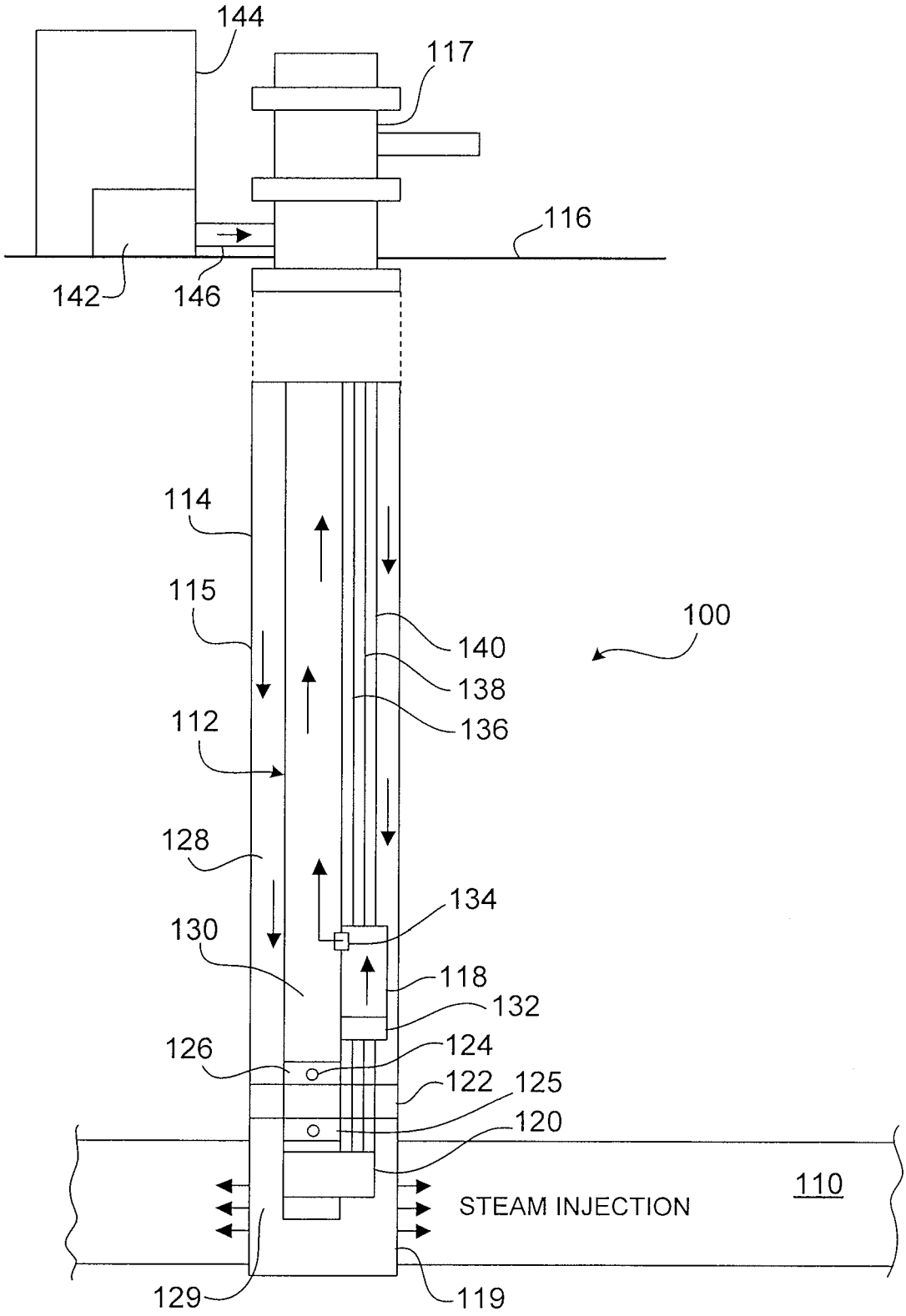
FIGS. 1A-1C are schematic views of an embodiment of a system for producing fluids from a subterranean zone.
Figure 1B:
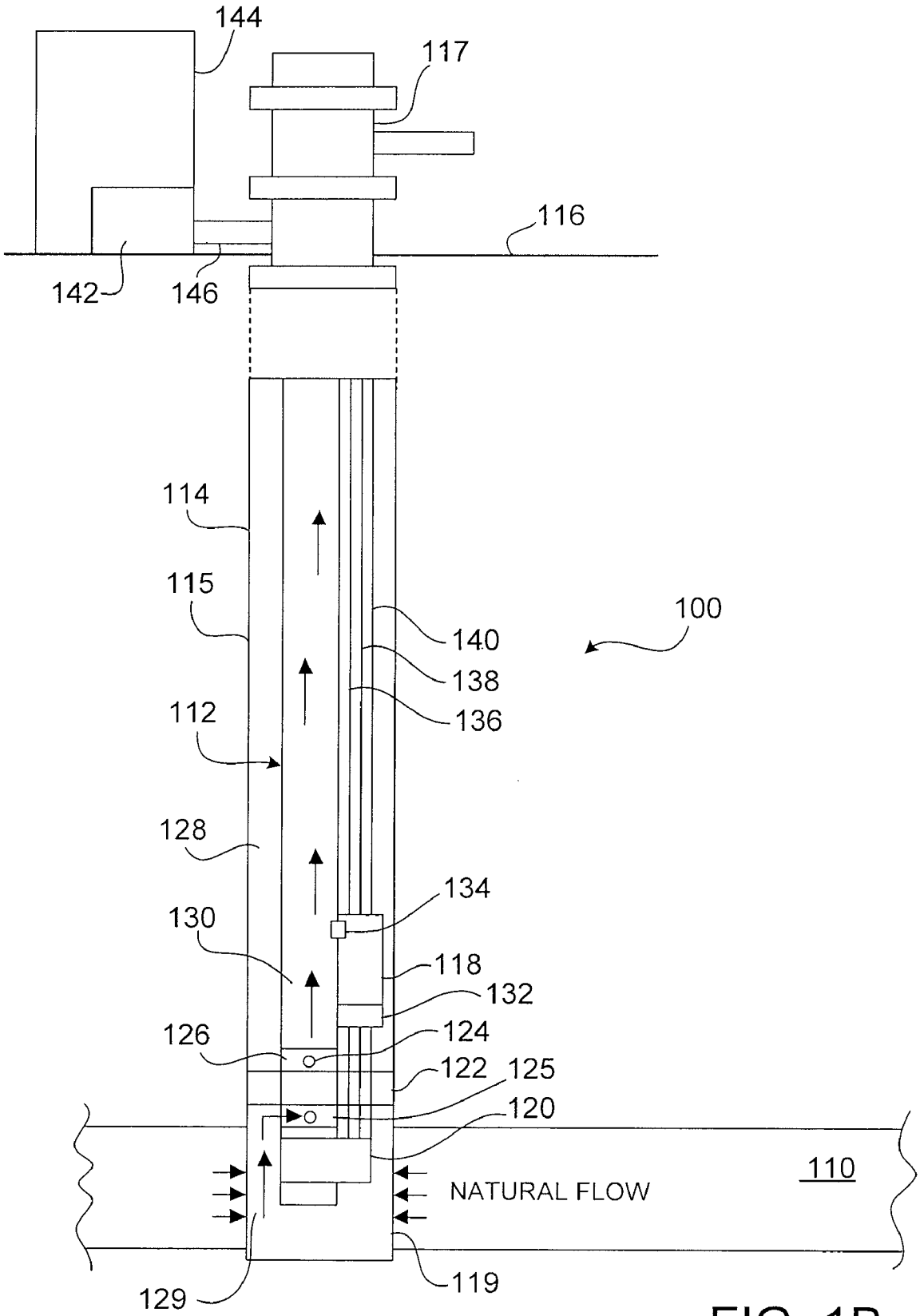
Figure 1C:
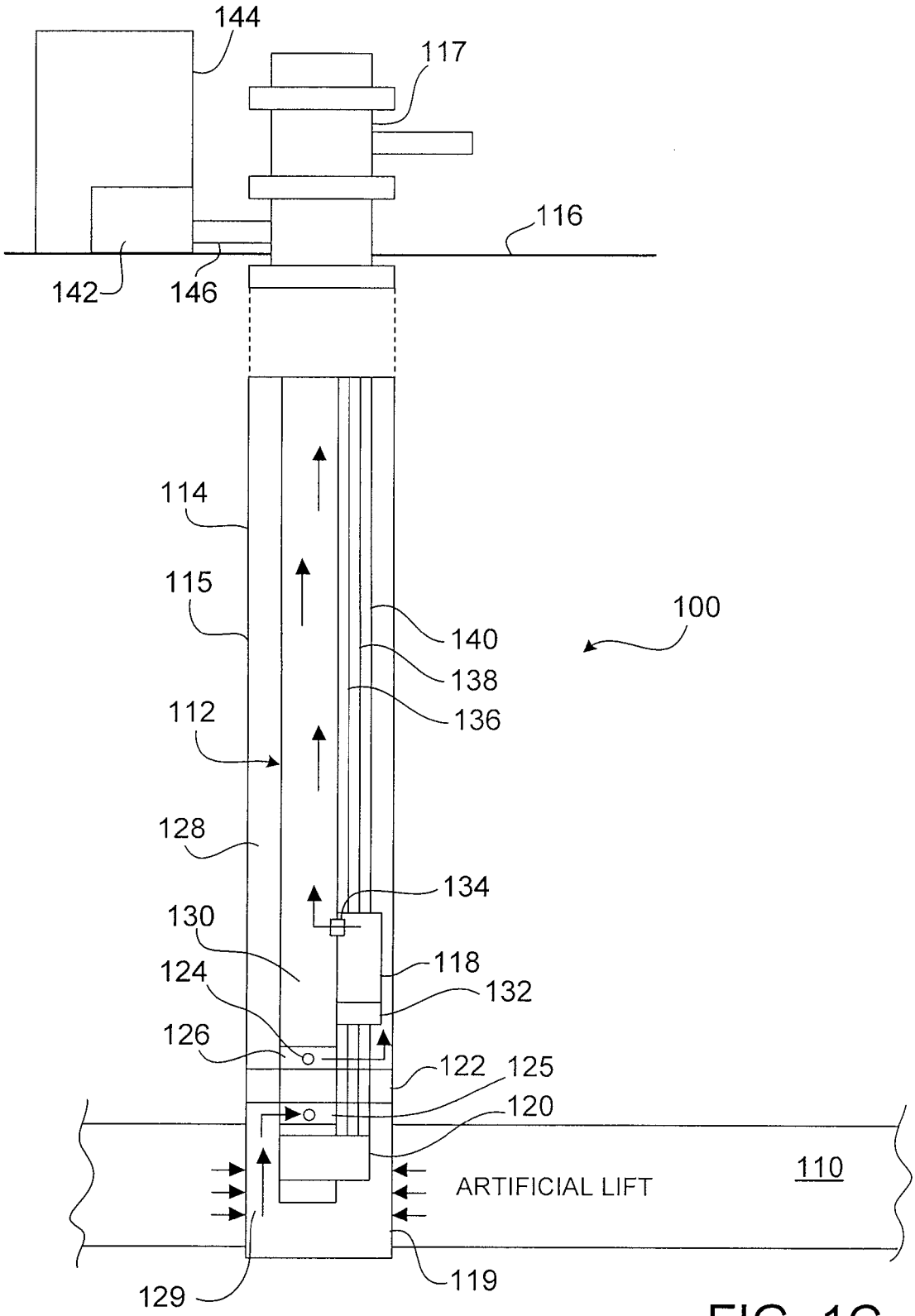

Referring to FIGS. 1A-1C, a system 100 for producing fluids from a reservoir or subterranean zone 110 includes a tubing string 112 disposed in a well bore 114. The tubing string 112 is adapted to communicate fluids from the subterranean zone to a ground surface 116. A downhole fluid lift system 118, operable to lift fluids towards the ground surface 116, is at least partially disposed in the well bore 114 and may be integrated into, coupled to or otherwise associated with the tubing string 112. A downhole fluid heater 120, operable to vaporize a liquid in the well bore 114, is also disposed in the well bore 114 and may be carried by the tubing string 112. As used herein, "downhole" devices are devices that are adapted to be located and operate in a well bore. A seal 122 (e.g., a packer seal) is disposed between the downhole fluid lift system 118 and the downhole fluid heater 120. The seal 122 may be carried by the tubing string 112. The seal 122 may be selectively actuable to substantially seal the annulus between the well bore 114 and the tubing string 112, thus hydraulically isolating a portion of the well bore 114 uphole of the seal 122 from a portion of the well bore 114 downhole of the seal 122. As will be explained in more detail below, the seal 122 limits the flow of heated fluid (e.g., steam) upwards along the well bore 114.

A well head 117 may be disposed proximal to a ground surface 116. The well head 117 may be coupled to a casing 115 that extends a substantial portion of the length of the well bore 114 from about the ground surface 116 towards the subterranean zone 110 (e.g., hydrocarbon-containing reservoir). The subterranean zone 110 can include part of a formation, a formation, or multiple formations. In some instances, the casing 115 may terminate at or above the subterranean zone 110 leaving the well bore 114 un-cased through the subterranean zone 110 (i.e., open hole). In other instances, the casing 115 may extend through the subterranean zone and may include apertures formed prior to installation of the casing 115 or by downhole perforating to allow fluid communication between the interior of the well bore 114 and the subterranean zone. Some, all or none of the casing 115 may be affixed to the adjacent ground material with a cement jacket or the like. In some instances, the seal 122 or an associated device can grip and operate in supporting the downhole fluid heater 120. In other instances, an additional locating or pack-off device such as a liner hanger (not shown) can be provided to support the downhole fluid heater 120. In each instance, the downhole fluid heater 120 outputs heated fluid into the subterranean zone 110.

In the illustrated embodiment, well bore 114 is a substantially vertical well bore extending from ground surface 116 to subterranean zone 110. However, the systems and methods described herein can also be used with other well bore configurations (e.g., slanted well bores, horizontal well bores, multilateral well bores and other configurations).

The tubing string 112 can be an appropriate tubular completion member configured for transporting fluids. The tubing string 112 can be jointed tubing or coiled tubing or include portions of both. The tubing string 112 carries the seal 122 and includes at least two valves 125, 126 bracketing the packer seal (e.g., valve 125 provided on one side of seal 122 and valve 126 provided on the other side of seal). Valves 125, 126 provide and control fluid communication between a well bore annulus 128 and an interior region 130 of the tubing string 112. When open, valves 125, 126 allow communication of fluid between the annulus 128 and tubing string interior 130, and when closed valves 125, 126 substantially block communication of fluid between the annulus 128 and tubing string interior 130. In this embodiment, the valves 125, 126 are electrically operated valves controlled from the surface 116. In other embodiments, valves 125, 126 can include other types of closure mechanisms (e.g., apertures in the tubing string 112 opened/closed by sliding sleeves and other types of closure mechanisms). Additionally, in other embodiments, the valves 125, 126 can be controlled in a number of other different manners (e.g., as check valves, thermostatically, mechanically via linkage or manipulation of the string 112, hydraulically, and/or in another manner).

The downhole fluid lift system 118 is operable to lift fluids towards the ground surface 116. In the illustrated embodiment, the downhole fluid lift system is an electric submersible pump 118 mounted on the tubing string 112. The electric submersible pump 118 has a pump inlet 132 which draws fluids from the well bore annulus 128 uphole of the packer seal 120 and a pump outlet 134 which discharges fluids into the interior region 130 of the tubing string 112. Power and control lines associated with electric submersible pump 118 can be attached to an exterior surface of tubing string 112, communicated through the tubing string 112, or communicated in another manner. In some embodiments, downhole fluid lift systems are implemented using other mechanisms such as, for example, progressive cavity pumps and gas lift systems as described in more detail below.

The downhole fluid heater 120 is disposed in the well bore 114 below the seal 122. The downhole fluid heater 120 may be a device adapted to receive and heat a recovery fluid. In one instance, the recovery fluid includes water and may be heated to generate steam. The recovery fluid can include other different fluids, in addition to or in lieu of water, and the recovery fluid need not be heated to a vapor state (e.g. steam) of 100% quality, or even to produce vapor. The downhole fluid heater 120 includes inputs to receive the recovery fluid and other fluids (e.g., air, fuel such as natural gas, or both) and may have one of a number of configurations to deliver heated recovery fluids to the subterranean zone 110. The downhole fluid heater 120 may use fluids, such as air and natural gas, in a combustion or catalyzing process to heat the recovery fluid (e.g., heat water into steam) that is applied to the subterranean zone 110. In some circumstances, the subterranean zone 110 may include high viscosity fluids, such as, for example, heavy oil deposits. The downhole fluid heater 120 may supply steam or another heated recovery fluid to the subterranean zone 110, which may penetrate into the subterranean zone 110, for example, through fractures and/or other porosity in the subterranean zone 110. The application of a heated recovery fluid to the subterranean zone 110 tends to reduce the viscosity of the fluids in the subterranean zone 110 and facilitate recovery to the ground surface 116.

In this embodiment, the downhole fluid heater is a steam generator 120. Gas, water, and air lines 136, 138, 140 convey gas, water, and air to the steam generator 120. In certain embodiments, the supply lines 136, 138, 140 extend through seal 122. In the embodiment of FIG. 1A, a surface based pump 142 pumps water from a supply such as supply tank 144 to piping 146 connected to wellhead 148 and water line 140. Various implementations of supply lines 136, 138, 140 are possible. For example, gas, water, and air lines 136, 138, 140 can be integral parts of the tubing string 112, can be attached to the tubing string, or can be separate lines run through well bore annulus 128. One exemplary tube system for use in delivery of fluids to a downhole heated fluid generator device includes concentric tubes defining at least two annular passages that cooperate with the interior bore of a tube to communicate air, fuel and recovery fluid to the downhole heated fluid generator.

In operation, well bore 114 is drilled into subterranean zone 110, and well bore 114 can be cased as appropriate. After drilling is completed, tubing string 112, downhole fluid heater 120, downhole fluid lift system 118, and seal 122 can be installed in the well bore 114. The seal 122 is then actuated to extend radially to press against and substantially seal with the casing 115. The valves 126, 125 are initially closed.

Referring to FIG. 1A, cooling fluid (e.g., water) can be supplied to uphole well bore annulus 128 at wellhead 148. The downhole fluid lift system 118 can be activated to circulate the cooling water downward through uphole well bore annulus 128 and upwards to the interior region 130 of tubing string 112. The combined effect of the isolation of uphole well bore annulus 128 from downhole well bore annulus 129 and the circulation of cooling fluid can reduce temperatures in the uphole well bore annulus 128. The reduced temperatures reduce the likelihood of heat damage to the downhole fluid lift system 118 and other devices in the uphole portion of the well bore 114 (e.g., the deterioration and premature failure of heat sensitive components such as rubber gaskets, electronics, and others). Of note, although additional steps are not required to actively cool the cooling fluid, in some instances, the cooling fluid may be cooled by exposure to atmosphere, using a refrigeration system (not shown), or in another manner.

The downhole fluid heater 120 can be activated, thus heating recovery fluid (e.g., steam) in the well bore. Because the apertures 126 in the downhole production sleeve are closed, the heated fluid passes into the target subterranean zone 110. The heated fluid can reduce the viscosity of fluids already present in the target subterranean zone 110 by increasing the temperature of such fluids and/or by acting as a solvent.

Referring to FIG. 1B, after a sufficient reduction in viscosity has been achieved, fluids (e.g., oil) are produced from the subterranean zone 110 to the ground surface 116 through the tubing string 112. Both the downhole fluid heater 120 and the downhole fluid lift system 118 can be turned off and the downhole valve 125 opened. Flow of cooling water into the uphole annulus 128 of the well bore 114 can be stopped. For some period of time after injection is completed, pressures in the subterranean zone 110 can be high enough to cause a natural flow of fluids from the reservoir to the ground surface 116 through the tubing string 112. During this period of time, the uphole valve 126 remains closed.

Referring to FIG. 1C, as the pressure in the subterranean zone 110 is depleted or as the subterranean zone 110 cools and fluid viscosity in the reservoir increases, production due to reservoir pressure can slow and even stop. As this occurs, the uphole valve 126 is opened and the downhole fluid lift system 118 is activated. The downhole fluid lift system 118 pumps fluids through downhole valve 125, out of uphole valve 126 and from uphole annulus 128 to the ground surface 116 through the interior region 130 of tubing string 112. In some instances, tubing string 112 can include additional flow control mechanisms. For example, tubing string can include check valves and/or other arrangements to direct the travel of fluids transferred into the interior region 130 of the tubing string 112 from fluid lift system 118 uphole in the tubing string 11.

As the subterranean zone 110 further cools and fluid viscosity in the reservoir further increases, production, even using the downhole fluid lift system, can slow. At this point, system 100 can be reconfigured for injection by closing valves 125, 126, and by activating the downhole fluid lift system 118 (to circulate cooling water) and the downhole fluid heater 120 to repeat the cycle described above. Such systems and methods can increase operational efficiencies because a single completion assembly can be installed in a well bore and remain in place during both injection and production phases of a cyclic production process. This reduces the number of trips in and out of the whole that would otherwise be required for systems and methods based on the use of separate injection and production assemblies.

The concepts described above can be implemented in a variety of systems and/or system configurations. For example, other approaches can be used to cool the downhole fluid lift system. Similarly, other downhole fluid lift systems can be used.

Figure 2:
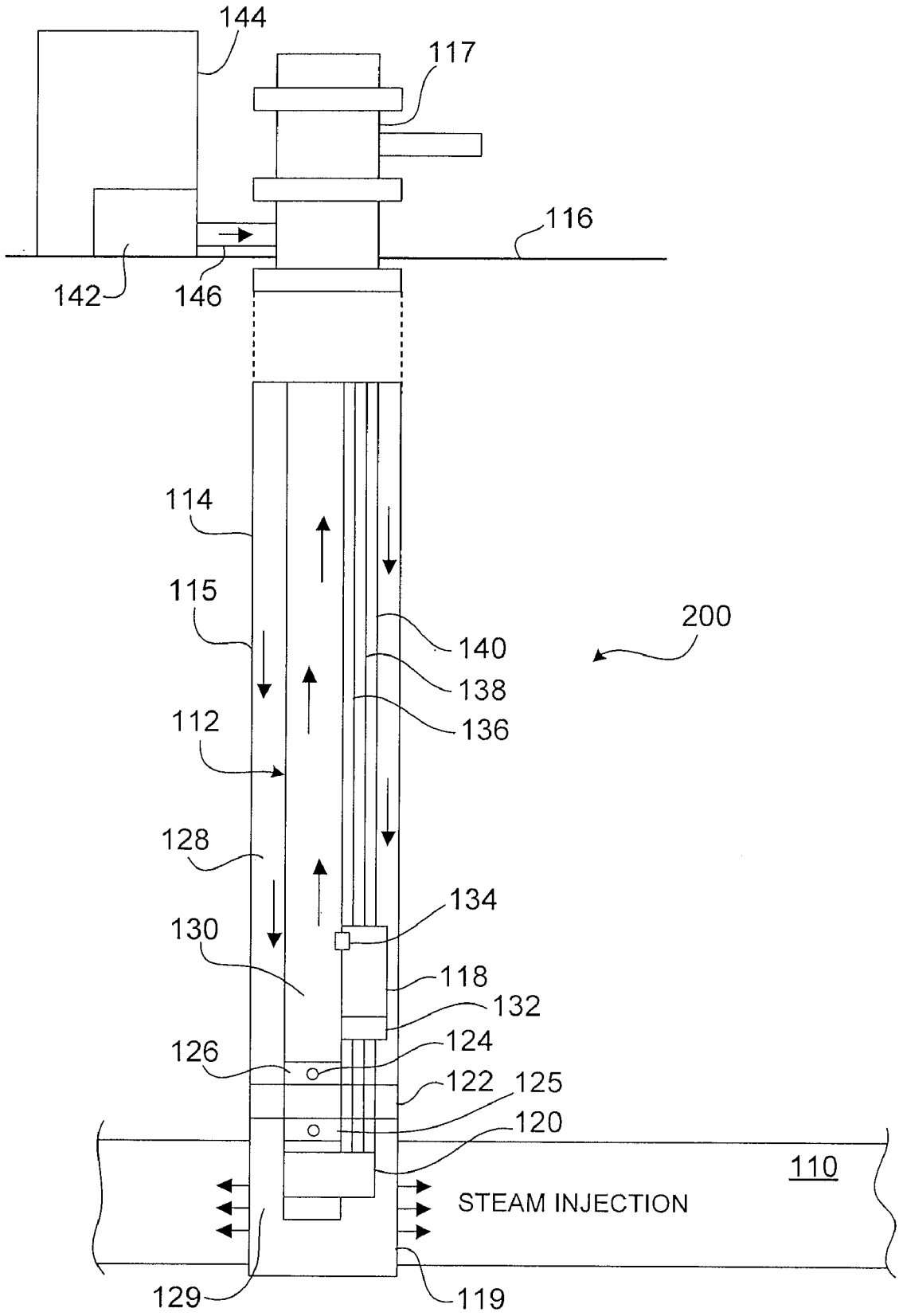
FIG. 2 is a schematic view of another embodiment of a system for producing fluids from a subterranean zone.

FIG. 2 depicts an alternate approach to cooling the downhole fluid lift system and other components in the uphole portion of the well bore 114. A system 200 can be arranged in substantially the same configuration as system 100. However, system 200 can use the surface pump to circulate cooling water through the uphole annulus 128 of the well bore 114 during the heated fluid injection phase. This can reduce the overall use of downhole fluid lift system 118 and, thus, can reduce the likelihood of wear related damage to the downhole fluid lift system. The surface pump can be the pump 142 used to supply water to the downhole fluid heater 120 or a separate pump can be used.

Figure 3:
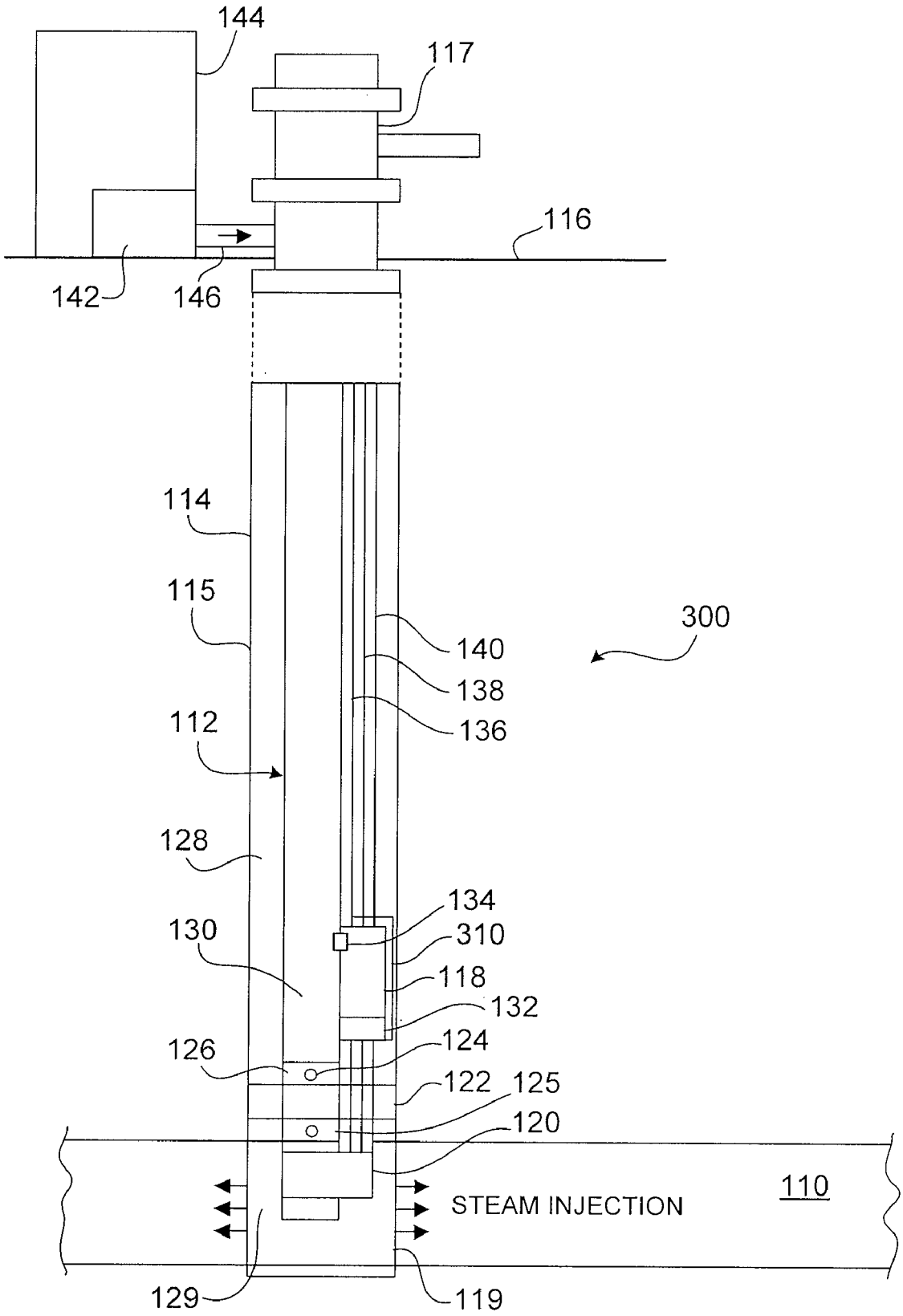
FIG. 3 is a schematic view of another embodiment of a system for producing fluids from a subterranean zone.

FIG. 3 depicts yet another alternate approach to cooling the downhole fluid lift system and other components in the uphole portion of the well bore 114. Like system 200, system 300 can reduce the overall use of downhole fluid lift system 118 and, thus, can reduce the likelihood of wear related damage to the downhole fluid lift system. System 300 is also arranged in substantially the same configuration as system 100 and system 200. However, system 300 includes an alternate mechanism for cooling the downhole fluid lift system 118 during the injection phase. The water line 140 that feeds the downhole fluid heater 120 is connected to a shroud 310 disposed around exterior portions of the downhole fluid lift system 118. During the injection phase, water flowing to the downhole fluid heater 120 passes through the shroud 310 providing both insulation and cooling for the downhole fluid lift system 118. Other components in the uphole portion of the well bore 114 can be similarly cooled using the water line 140.

Figure 4:
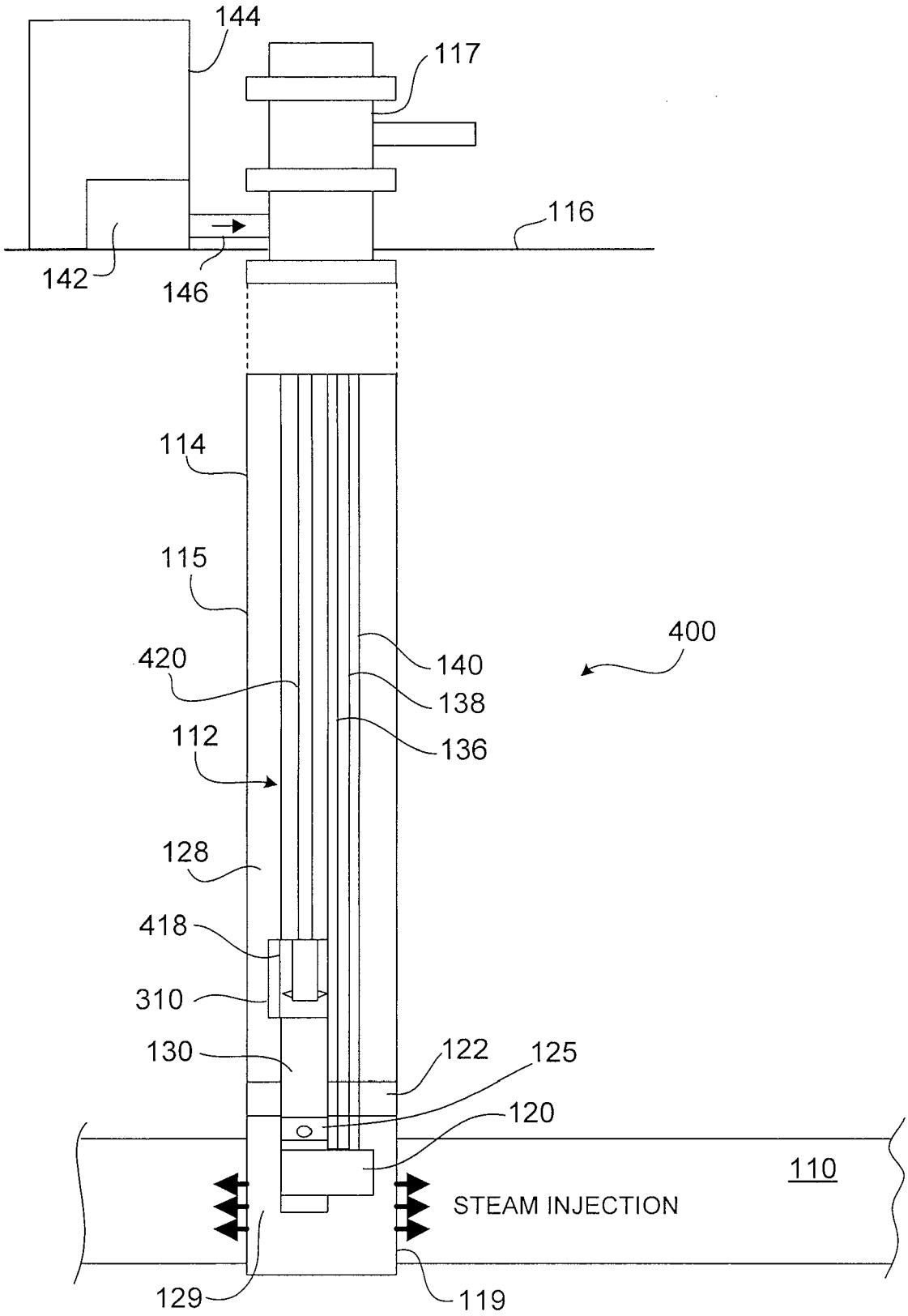
FIG. 4 is a schematic view of another embodiment of a system for producing fluids from a subterranean zone.

Referring to FIG. 4, systems can also be implemented using alternate downhole fluid lift systems. For example, system 400 is implemented using a progressive cavity pump 418 disposed in line with the tubing string 112 as the downhole fluid lift system. The progressive cavity pump 418 is driven by a drive shaft 420 extending downward to the progressive cavity pump through the interior region 130 of tubing string 112. System 400 is also arranged in substantially the same configuration as the previously described systems 100, 200, 300. However, because the progressive cavity pump 418 is arranged in line with the tubing string 112, the uphole valve can be omitted. In some embodiments, system 400 includes the shroud 310 described above as arranged above for cooling the progressive cavity pump 418.

Figure 5:
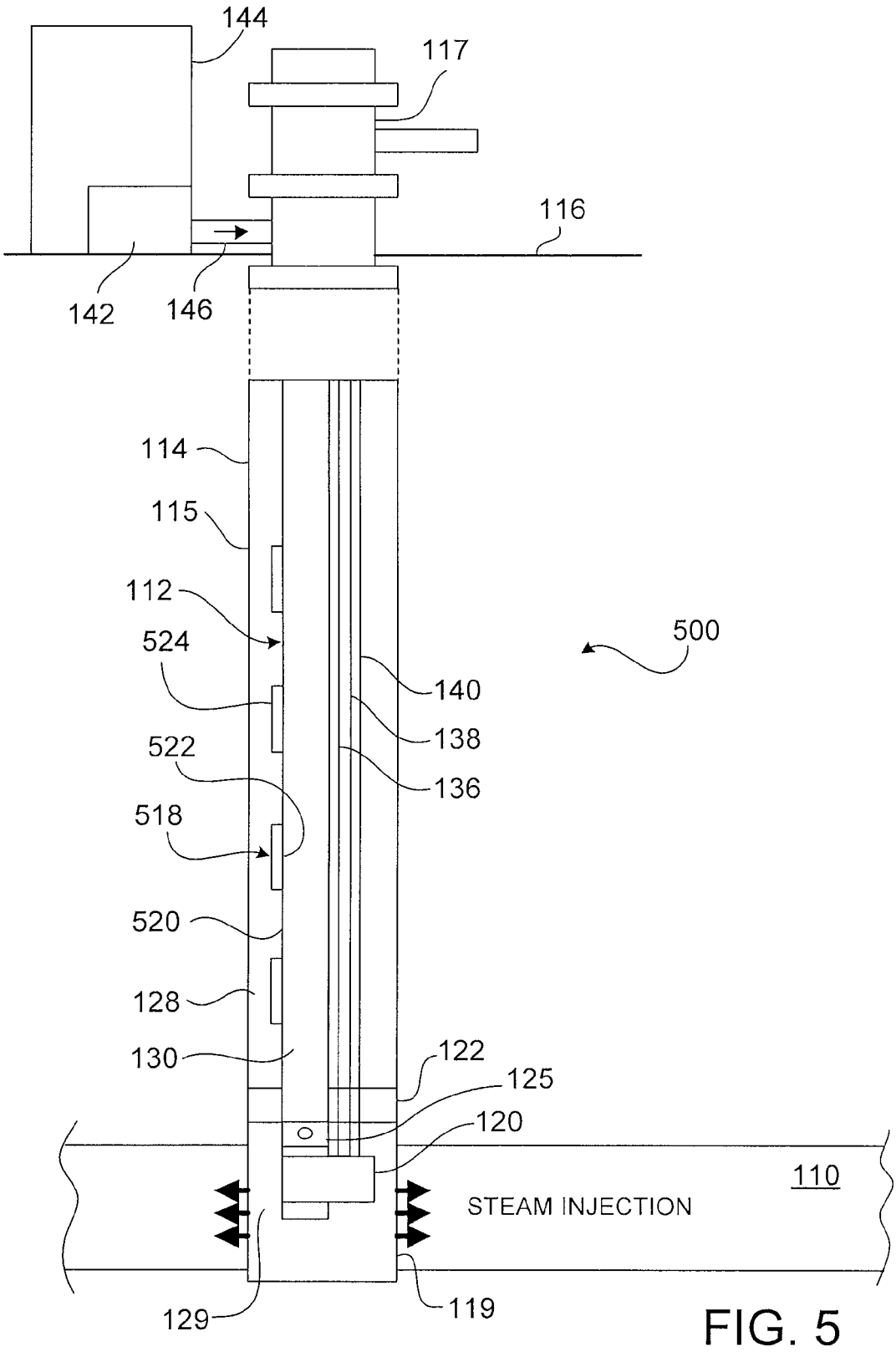
FIG. 5 is a schematic view of another embodiment of a system for producing fluids from a subterranean zone.

Referring to FIG. 5, systems can also be implemented using a gas lift system as the downhole fluid lift system. For example, system 500 is implemented using a gas lift production assembly rather than pumps as the downhole fluid lift system. System 500 is also arranged in substantially the same configuration as the previously described system 400. However, a gas lift production assembly 518 which includes at least one gas lift production liner 520 with gas lift mandrels 522. The gas lift mandrels 522 each include one or more gas lift valves 524. Dummies can be placed in the gaslift mandrels 522 during the injection phase so that the uphole well bore annulus 128 does not need to be cooled. After the injection phase is completed, the dummies are removed and gas lift valves installed (e.g., by using a wireline system). The reservoir fluid is then lifted to the ground surface 116 using artificial lift provided by the gas lift system 518.

A number of embodiments of the invention have been described. Nevertheless, it will be understood that various modifications may be made without departing from the spirit and scope of the invention. Accordingly, other embodiments are within the scope of the following claims.

What is claimed is:

1. A system for producing fluids from a subterranean zone, comprising:

a downhole fluid lift system adapted to be at least partially disposed in a well bore, the downhole fluid lift system operable to lift fluids towards a ground surface;

a downhole fluid heater adapted to be disposed in the well bore, the downhole fluid heater operable to generate heat in the well bore; and a seal between the downhole fluid lift system and the downhole fluid heater, the seal operable to selectively seal with the well bore and isolate and prevent fluid communication to a portion of the well bore uphole of the seal containing and in fluid communication with an inlet of the downhole fluid lift system from a portion of the well bore downhole of the seal containing and in fluid communication with the downhole fluid heater.

2. The system of claim 1, wherein the downhole fluid lift system comprises a gas lift system.

3. The system of claim 1, wherein the downhole fluid lift system comprises at least one of an electric submersible pump or a progressive cavity pump.

4. The system of claim 1, wherein the downhole fluid lift system is adapted to circulate fluids in the portion of the well bore containing the downhole fluid lift system while isolated from the portion of the well bore containing the downhole fluid heater.

5. The system of claim 1, further comprising a surface pump adapted to circulate fluids in the portion of the well bore containing the downhole fluid lift system while isolated from the portion of the well bore containing the downhole fluid heater.

6. The system of claim 1, wherein the downhole fluid heater comprises a steam generator.

7. The system of claim 1 wherein the well bore extends from the ground surface to a terminal end in or below the subterranean zone.

8. A system comprising:

a tubing string having an inlet;

a pump;

a downhole fluid heater operable to vaporize a liquid in a well bore; and a seal between the inlet of the tubing string and the downhole fluid heater, the seal adapted to substantially seal an annulus between the tubing string and the well bore and isolate and prevent fluid communication to a portion of the well bore uphole of the seal containing and in fluid communication with an inlet of the pump from a portion of the well bore downhole of the seal containing and in fluid communication with the downhole fluid heater.

9. The system of claim 8, wherein the pump comprises an electric submersible pump.

10. The system of claim 8, wherein the pump is adapted to circulate fluids in the portion of the well bore uphole of the seal.

11. The system of claim 8, further comprising a surface pump.

12. The system of claim 8, wherein the downhole fluid heater comprises a steam generator.

13. A method, comprising:

isolating and preventing fluid communication to a first portion of a well bore containing an artificial lift system and in fluid communication with an inlet of the artificial lift system from a second portion of the well bore;

while the artificial lift system is in the well bore, generating heat in the second portion of the well bore and introducing heated fluid into a subterranean zone from the second portion of the well bore;

providing fluid communication to the first portion of a well bore containing the artificial lift system from the second portion of the well bore; and artificially lifting fluids from the second portion of the well bore to the first portion of the well bore and to a ground surface using the artificial lift system.

14. The method of claim 13, further comprising circulating fluid in the portion of the well bore containing the artificial lift system while introducing heated fluid into the subterranean zone.

15. The method of claim 14, wherein circulating fluid comprises circulating fluid using the artificial lift system.

16. The method of claim 14, wherein circulating fluid comprises circulating fluid using a surface pump.

17. The method of claim 13, further comprising cooling a downhole pump present in the well bore while vapor is being generated.

18. The method of claim 13, further comprising heating the fluid in the well bore.

* * * * *